US006708657B2

(12) United States Patent
Iwaki et al.

(10) Patent No.: US 6,708,657 B2
(45) Date of Patent: Mar. 23, 2004

(54) APPARATUS AND METHOD FOR CONTROLLING VARIABLE VALVE TIMING MECHANISM

(75) Inventors: Haruhiro Iwaki, Atsugi (JP); Satoru Watanabe, Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/152,620

(22) Filed: May 23, 2002

(65) Prior Publication Data

US 2002/0174843 A1 Nov. 28, 2002

(30) Foreign Application Priority Data

May 23, 2001 (JP) ..... 2001-154370

(51) Int. Cl.[7] ..... F01L 1/34

(52) U.S. Cl. ..... 123/90.17; 123/90.15; 123/90.16

(58) Field of Search ..... 123/90.15, 90.16, 123/90.17

(56) References Cited

U.S. PATENT DOCUMENTS 5,626,108 A * 5/1997 Kato et al. ..... 123/90.15
6,260,524 B1 * 7/2001 Wachi ..... 123/90.15

FOREIGN PATENT DOCUMENTS

JP 10-153104 6/1998

* cited by examiner

*Primary Examiner*—Thomas Denion
*Assistant Examiner*—Jaime Corrigan
(74) *Attorney, Agent, or Firm*—Foley & Lardner

(57) ABSTRACT

In an apparatus for, controlling a variable valve timing mechanism that variably controls valve timing of an engine by changing a rotation phase of a camshaft relative to a crankshaft due to friction braking of an electromagnetic brake, the rotation phase is controlled while limiting a change rate of the rotation phase.

17 Claims, 6 Drawing Sheets

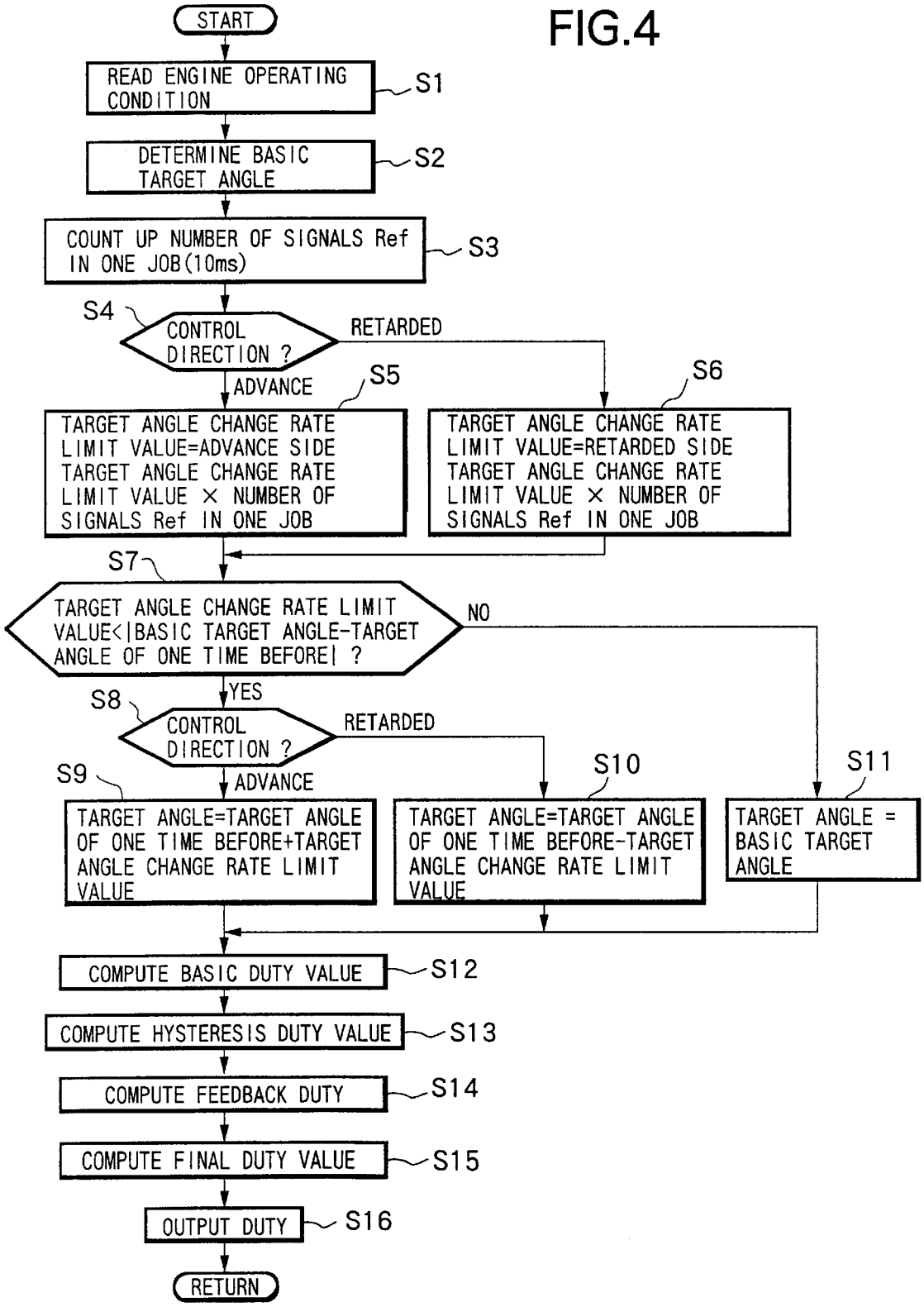
FIG.4
START
READ ENGINE OPERATING CONDITION
S1
DETERMINE BASIC TARGET ANGLE
S2
COUNT UP NUMBER OF SIGNALS Ref IN ONE JOB(10ms)
S3
S4
CONTROL DIRECTION ?
RETARDED
ADVANCE
S5
S6
TARGET ANGLE CHANGE RATE LIMIT VALUE=ADVANCE SIDE TARGET ANGLE CHANGE RATE LIMIT VALUE × NUMBER OF SIGNALS Ref IN ONE JOB
TARGET ANGLE CHANGE RATE LIMIT VALUE=RETARDED SIDE TARGET ANGLE CHANGE RATE LIMIT VALUE × NUMBER OF SIGNALS Ref IN ONE JOB
S7
TARGET ANGLE CHANGE RATE LIMIT VALUE<|BASIC TARGET ANGLE-TARGET ANGLE OF ONE TIME BEFORE| ?
NO
YES
S8
CONTROL DIRECTION ?
RETARDED
ADVANCE
S9
S10
S11
TARGET ANGLE=TARGET ANGLE OF ONE TIME BEFORE+TARGET ANGLE CHANGE RATE LIMIT VALUE
TARGET ANGLE=TARGET ANGLE OF ONE TIME BEFORE-TARGET ANGLE CHANGE RATE LIMIT VALUE
TARGET ANGLE = BASIC TARGET ANGLE
COMPUTE BASIC DUTY VALUE
S12
COMPUTE HYSTERESIS DUTY VALUE
S13
COMPUTE FEEDBACK DUTY
S14
COMPUTE FINAL DUTY VALUE
S15
OUTPUT DUTY
S16
RETURN

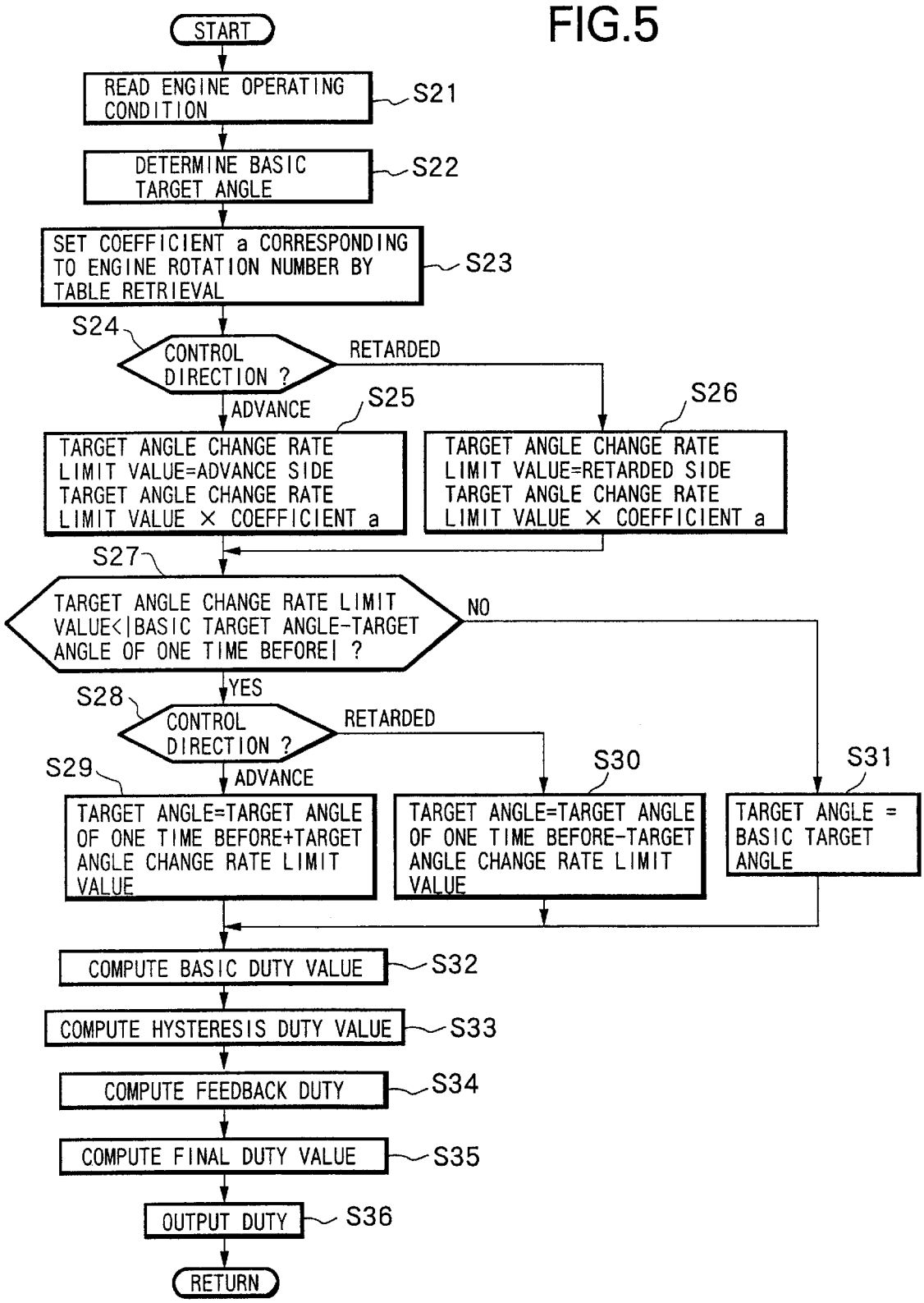
FIG.5
START
READ ENGINE OPERATING CONDITION
S21
DETERMINE BASIC TARGET ANGLE
S22
SET COEFFICIENT a CORRESPONDING TO ENGINE ROTATION NUMBER BY TABLE RETRIEVAL
S23
S24
CONTROL DIRECTION ?
RETARDED
ADVANCE
S25
S26
TARGET ANGLE CHANGE RATE LIMIT VALUE=ADVANCE SIDE TARGET ANGLE CHANGE RATE LIMIT VALUE × COEFFICIENT a
TARGET ANGLE CHANGE RATE LIMIT VALUE=RETARDED SIDE TARGET ANGLE CHANGE RATE LIMIT VALUE × COEFFICIENT a
S27
TARGET ANGLE CHANGE RATE LIMIT VALUE<|BASIC TARGET ANGLE-TARGET ANGLE OF ONE TIME BEFORE| ?
NO
YES
S28
CONTROL DIRECTION ?
RETARDED
ADVANCE
S29
S30
S31
TARGET ANGLE=TARGET ANGLE OF ONE TIME BEFORE+TARGET ANGLE CHANGE RATE LIMIT VALUE
TARGET ANGLE=TARGET ANGLE OF ONE TIME BEFORE-TARGET ANGLE CHANGE RATE LIMIT VALUE
TARGET ANGLE = BASIC TARGET ANGLE
COMPUTE BASIC DUTY VALUE
S32
COMPUTE HYSTERESIS DUTY VALUE
S33
COMPUTE FEEDBACK DUTY
S34
COMPUTE FINAL DUTY VALUE
S35
OUTPUT DUTY
S36
RETURN

APPARATUS AND METHOD FOR CONTROLLING VARIABLE VALVE TIMING MECHANISM

FIELD OF THE INVENTION

The present invention relates to a control technology of a variable valve timing mechanism constituted to variably control valve timing of an intake valve and an exhaust valve by changing a rotation phase of a camshaft relative to a crankshaft using an electromagnetic brake.

BACKGROUND OF THE INVENTION

There has been known a conventional variable valve timing apparatus for an engine, for changing a rotation phase of a camshaft relative to a crankshaft by controlling a rotation delay of the camshaft relative to the crankshaft based on a friction braking by an electromagnetic brake, to variably control valve timing of intake and exhaust valves of an engine (Japanese Unexamined Patent Publication 10-153104).

In this variable valve timing apparatus, for example, a basic control amount of the electromagnetic brake is calculated based on a target rotation phase (target angle) and an engine rotation speed, while calculating a feedback control amount from a deviation between the target rotation phase and an actual rotation phase. Then, a final control amount (for example, duty control amount) is determined from the basic control amount and the feedback control amount, to control a current flowing in an electromagnetic coil constituting the electromagnetic brake.

The variable valve timing mechanism according to the above electromagnetic brake control has high response characteristics compared with a variable valve timing mechanism according to an oil pressure control. Therefore, when a change in target angle is large, an actual angle (rotation phase) is abruptly changed, resulting in a possibility that an abrupt change occurs in drivability to bring an engine stall.

SUMMARY OF THE INVENTION

The present invention has been achieved in view of the foregoing problems, and has an object of suppressing an abrupt change of valve timing, ensuring stable drivability, and preventing an occurrence of engine stall, in a variable valve timing mechanism according to an electromagnetic brake control.

In order to achieve the above object, the present invention is constituted to control a variable valve timing mechanism that variably controls valve timing of an intake valve or an exhaust valve by changing a rotation phase of a camshaft relative to a crankshaft due to friction braking of an electromagnetic brake, while limiting a change rate of the rotation phase.

According to the present invention, even when a target value of the rotation phase is largely changed, since the change rate of the rotation phase to be actually controlled is limited, an abrupt change of valve timing can be suppressed, to thereby prevent an occurrence of engine stall.

The other objects and features of this invention will become understood from the following description with accompanying drawings.

BRIEF EXPLANATION OF THE DRAWING

FIG. 4 is a flow chart showing a phase control according to a first embodiment.

FIG. 5 is a flow chart showing a phase control according to a second embodiment.

EMBODIMENT

An embodiment according to the invention will be explained as follows.

Figure 1:
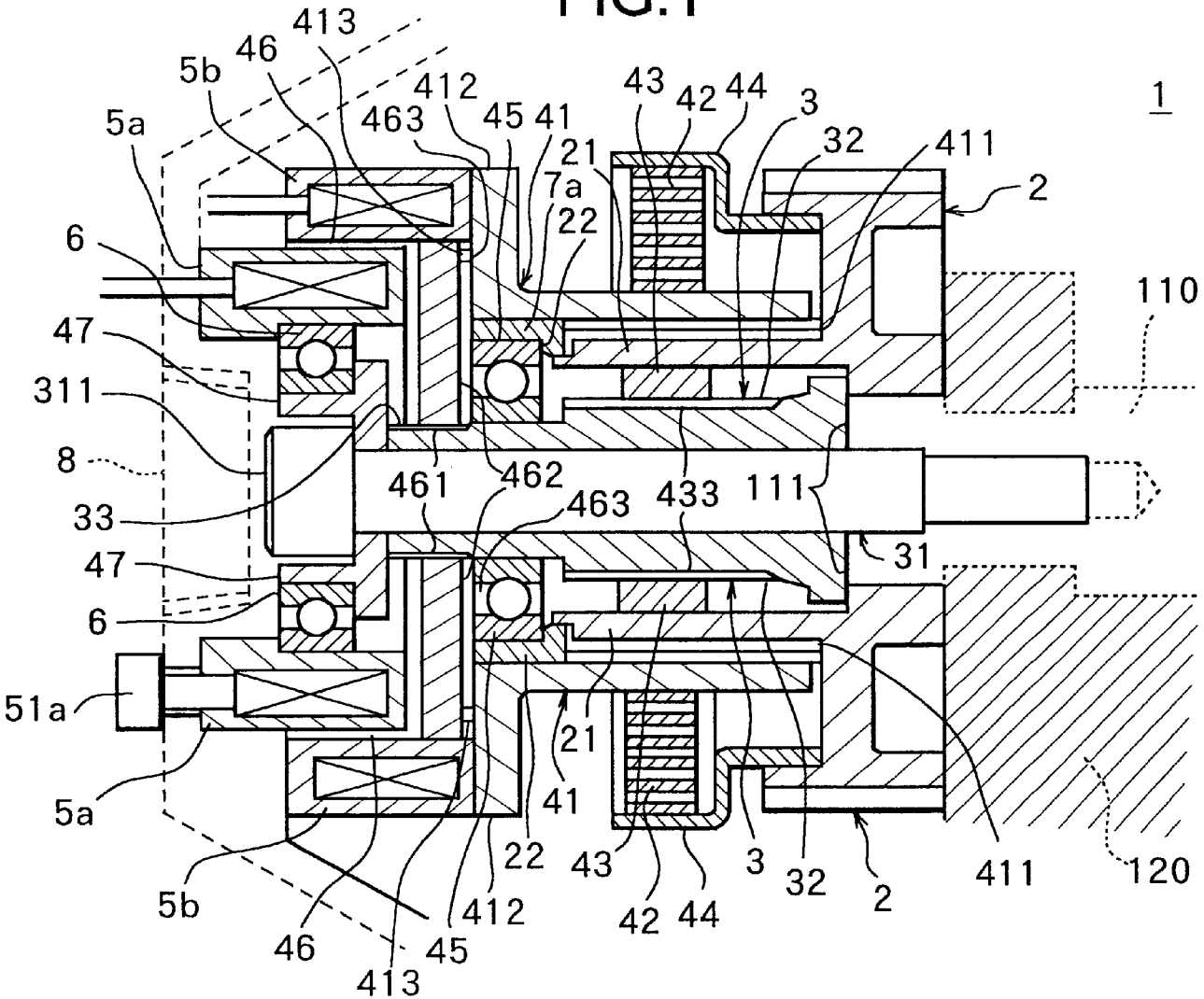
FIG. 1 is a sectional view of a variable valve timing mechanism according to an embodiment of the present invention.
Figure 2:
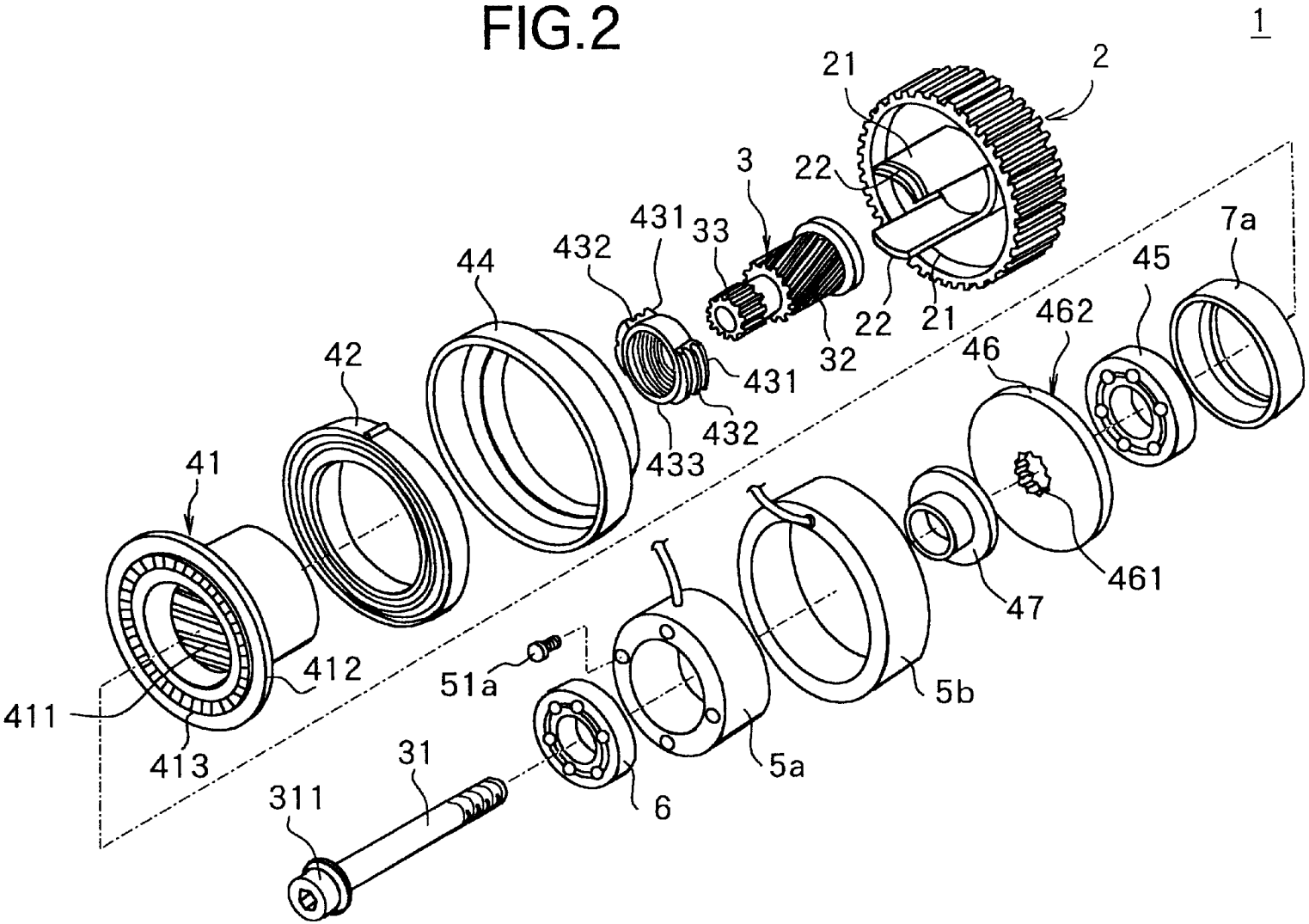
FIG. 2 is an exploded perspective view of the variable valve timing mechanism according to the embodiment.

FIG. 1 is a sectional view of a variable valve timing mechanism using an electromagnetic brake in the embodiment and FIG. 2 is an exploded perspective view thereof.

In variable valve timing mechanism 1 shown in FIG. 1 and FIG. 2, a pulley 2 (or sprocket) is rotatably supported around an axis of an end portion 111 of a camshaft 110 rotatably supported to a cylinder head 120. Pulley 2 is supported to camshaft 110 in a relative rotatable manner, and is rotated in synchronization with the rotation of a crankshaft of an engine.

On an extending line of end portion 111 of camshaft 110 is fixed a transmission member 3 with a gear being formed around an axis thereof, by a bolt 31 and the rotation of pulley 2 is transmitted to transmission member 3 through a transmission mechanism to be described later.

A cylindrical drum 41 with a flange is disposed on the same axis as camshaft 110, and between drum 41 and pulley 2 is disposed a coil spring 42 for urging a rotation phase of drum 41 to retard. That is, a case member 44 is fixed to pulley 2 and an outer peripheral end of coil spring 42 is fixed to an inner peripheral surface portion of case member 44 and an inner peripheral end of coil spring 42 is fixed to an outer peripheral surface of drum 41.

A gear 32 formed around the axis of transmission member 3 is in mesh with a gear 433 formed on an inner periphery of a cylindrical piston member 43 by a helical mechanism with a helical gear.

Engagement portions 431, 431 are projectingly formed on opposite two portions of an outer peripheral surface of piston member 43, to be engaged between pawl members 21, 21 extending in an axial direction of camshaft 110 from a rotation center portion of pulley 2. Piston member 43 and pulley 2 are rotated on the same phase by this engagement.

Engagement portions 431, 431 of piston member 43 are formed with male screws 432 as a center thereof being an axis of piston member 43, respectively, to be engaged with female screws 411 formed on an inner peripheral surface of drum 41 by a screw function.

A drum bearing member 45 is disposed between an outer periphery of transmission member 3 and an inner periphery of drum 41, to bear the relative rotation of them. A pawl receiving member 7*a* is disposed between drum bearing member 45 and the inner peripheral surface of drum 41.

Pawl receiving member 7*a* is supported by the inner peripheral surface of drum 41 and contacts step portions 22, 22 formed on outer peripheral surfaces of tip end portions of pawl members 21, 21 to retain pawl members 21, 21 in a radial direction of camshaft 110.

A sucked member 46 is formed with an internal spur gear 461 at a rotation center thereof and the gear 461 is engaged with a spur gear 33 formed on a tip end portion of transmission member 3. Thereby, sucked member 46 is constituted to be slidable to transmission member 3 in an axial direction of transmission member 3 and also rotatable on the same phase as transmission member 3.

A gear 413 is formed on a side surface of a flange portion 412 of drum 41 to face a gear 463 formed on one surface 462 of sucked member 46. As a result, both of these gears are in mesh to engage drum 41 and sucked member 46 in the rotation direction.

A first electromagnetic solenoid 5*b* and a second electromagnetic solenoid 5*a* are positioned through a bearing member 6 so as to surround an axis line of camshaft 110, and also to surround transmission member 3 fixed to the end portion 111 of camshaft 110, and an outer peripheral surface of bolt 31 fixing transmission member 3.

A spacer member 47 is inserted fixedly between a head portion 311 of bolt 31 and the tip end portion of transmission member 3 and, on an outer peripheral surface side of spacer member 47, second electromagnetic solenoid 5*a* is disposed through bearing member 6. Further, first electromagnetic solenoid 5*b* constituting an electromagnetic brake is disposed between second electromagnetic solenoid 5*a* and an outer peripheral surface of sucked member 46. Second electromagnetic solenoid 5*a* is fixed to a case 8 by a bolt 51*a*.

An operation of the embodiment will be explained as follows.

In order to change a rotation phase of camshaft 110 into an advance side, piston member 43 is moved to the axial direction of camshaft 110 by a magnetic field generated by first electromagnetic solenoid 5*b*.

Namely, first of all, when sucked member 46 is sucked by the magnetic field generated by second electromagnetic solenoid 5*a*, gear 463 of sucked member 46 and gear 413 of drum 41 are separated from each other, so that drum 41 can be relatively rotated to pulley 2.

Then, drum 41 is sucked by the magnetic field generated by first electromagnetic solenoid 5*b* to be pushed against an end face of first electromagnetic solenoid 5*b*, thereby performing a friction braking. Accordingly, drum 41 is subjected to a relative rotation due to a rotation delay to pulley 2 against an urging force of coil spring 42, and piston member 43 in mesh by screw 411 and screw 432 is moved to the axial direction of camshaft 110. Since piston member 43 and transmission member 3 are engaged by the helical mechanism, the rotation phase of transmission member 3, as well as camshaft 110 is changed to the advance side to pulley 2 by the movement of piston member 43. As a result, as a current value to first electromagnetic solenoid 5*b* is increased and a braking force (slide friction) against the urging force of coil spring 42 is increased, the rotation phase of camshaft 110 is changed further to the advance side of camshaft 110.

As described above, since the rotation phase of camshaft 110 is changed to pulley 2 (crankshaft) depending on a rotation delay amount of drum 41 determined corresponding to the braking force by the electromagnetic brake and the braking force of the electromagnetic brake is controlled by duty-controlling a current value supplied to first electromagnetic solenoid 5*b*, a change amount (advance amount) of the rotation phase can be continuously controlled by changing a duty ratio. The current value supplied to first electromagnetic solenoid 5*b* is increased in response to an increase in duty value (%) equivalent to a control amount of the electromagnetic brake.

Figure 3:
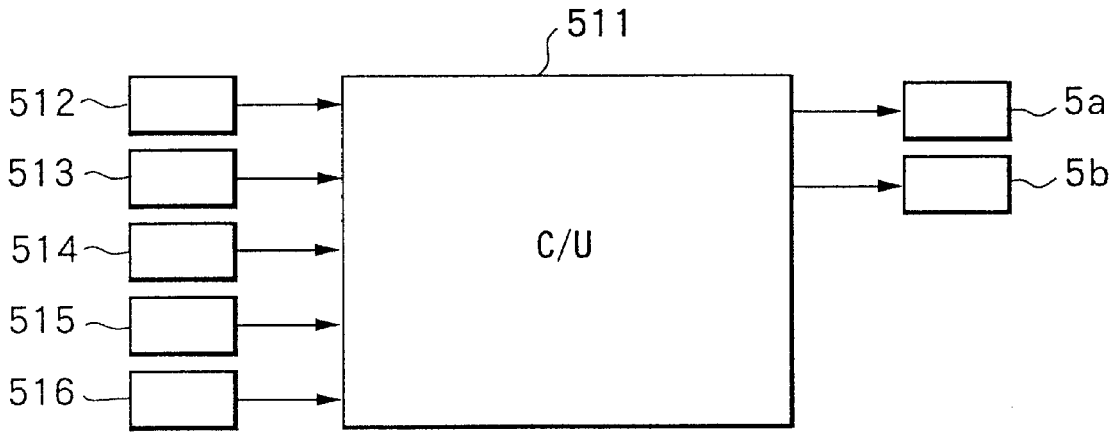
FIG. 3 is a block diagram of the variable valve timing mechanism according to the embodiment.

FIG. 3 is a block diagram showing a control system of the variable valve timing mechanism having the above constitution. A control unit 511 incorporating therein a microcomputer for controlling the power supply to first electromagnetic solenoid 5*b* and second electromagnetic solenoid 5*a*, is input with detections signals from an air flow meter 512 for detecting an engine intake air amount, a crank angle sensor 513 for detecting a crank rotation, a water temperature sensor 514 for detecting an engine cooling water temperature, an atmosphere temperature sensor 515 for detecting an atmosphere temperature, a cam sensor 516 for detecting a cam rotation and the like.

Control unit 511 duty-controls the power supply to first electromagnetic solenoid 5*b* to change the rotation phase of camshaft 110. When the rotation phase reaches a target rotation phase, gear 463 of sucked member 46 and gear 413 of drum 41 are engaged with each other by cutting off the power supply to second electromagnetic solenoid 5*a*, and drum 41 is fixed in a phase state at that time to pulley 2, to cut off the power supply to first electromagnetic solenoid 5*b*.

The duty control provided with a limiting function of the rotation phase change rate according to the invention will be described. The description will be made for the case where the variable valve timing mechanism is applied to the one that controls valve timing of an intake valve. It is assumed that a target angle is increased when the valve timing of the intake valve is controlled to an advance direction.

FIG. 4 shows a flowchart of a first embodiment of the duty control.

In FIG. 4, at S1, engine operating conditions an intake air amount, an engine rotation speed and the like are read in.

The engine rotation speed is calculated based on a detection signal from crank angle sensor 513.

At S2, a basic target value (basic target angle) of a rotation phase is determined based on an engine load such as a basic fuel injection quantity Tp and an engine rotation speed Ne.

At S3, the number of output of detection signal Ref from cam sensor 515 in one job cycle (for example, 10 ms) of this routine is counted up. The number of output is proportional to engine rotation speed Ne.

At S4, a control direction of the valve timing is judged based on a change direction of the basic target angle.

When it is judged that the valve timing of the intake valve is controlled to the advance direction at S4, control proceeds to S5, wherein a limit value of a target angle change rate which is a maximum change amount of target angle is calculated as follows.

Limit value of target angle change rate=Advance side limit value of target angle change at advance side×Ref count value.

Here, the advance side limit value of target angle change rate is a fixed value set according to an advance direction control. By multiplying this limit value and Ref count value proportional to the engine rotation speed, the limit value of the target angle change rate is calculated.

When it is judged that the valve timing of the intake valve is controlled to a retarded condition at S4, control proceeds to S6, wherein the limit value of target angle change rate is calculated as follows.

Limit value of target angle change rate=Retarded side limit value of target angle change×Ref count value.

Here, the retarded side limit value of target angle change rate is a fixed value set according to a retard direction control, and is set to a value larger than the advance side limit value of target angle change rate.

Then control proceeds to S7, wherein it is judged whether or not deviation (absolute value) between the basic target angle set at S2 and the target angle finally set at previous time is larger than the above calculated limit value of target angle change rate.

When it is judged that the deviation is larger than the limit value of target angle change rate at S7, control proceeds to S8, wherein the control direction of the valve timing is judged again in the same manner as at S4.

When it is judged that the valve timing of the intake valve is controlled to the advance direction, control proceeds to S9, wherein a final target angle is calculated by adding the limit value of target angle change rate for advance direction control calculated at S5 to the target angle finally set at previous time.

When it is judged that the valve timing of the intake valve is controlled to the retarded direction at S8, control proceeds to S10 wherein a final target angle is calculated by subtracting the limit value of target angle change rate for retarded direction control calculated at S6 from the target angle finally set at previous time.

When it is judged that the deviation is equal to or less than the limit value of target angle change rate, control proceeds to S11, wherein a final target angle is determined as the basic target angle set at S2.

Next, control proceeds to S12, wherein, based on the target angle, a basic-duty value is retrieved from a basic duty map storing the basic duty value (basic control amount) which controls power supply to second electromagnetic solenoid 5*a*.

At S13, a hysteresis duty value is computed from a table based on the engine rotation speed. In general, as the engine rotation speed is lower, the engine temperature is low, and also a lubricating oil supply amount is reduced, thereby resulting in an increase of viscosity resistance in the advance and retarded direction rotation of the camshaft. Therefore, the hysteresis value is set to a larger hysteresis duty value corresponding to the above condition. In the case of advance direction control, a positive hysteresis duty value is set, while in the case of retarded direction control, a negative hysterisis duty value is set.

At S14, a feedback duty value is computed by a PID operation (proportional integral and derivative).

At S15, a final duty value is calculated by adding the basic duty value, the feedback duty value, and the hysteresis duty value. At next S16, power supply to first electromagnetic solenoid 5*b* is controlled based on the final duty value.

In this way, when the change amount of target angle (basic target angle) set according to the engine operating condition is large, the change amount of target angle is limited by the limit value of target angle change rate. Therefore, an abrupt change of drivability can be restricted and an occurrence of engine stall can be prevented.

At the advance direction control in which an influence of drivability change caused by a change in valve timing is large and at the low engine rotation speed, the limit value of target angle change rate is further reduced to ensure the restraining function of the drivability change. At the retarded direction control in which the influence of drivability change caused by the change in valve timing is relatively small and at the high engine rotation speed, the limit value of target angle change rate is relatively increased to ensure response characteristics.

FIG. 5 shows a flowchart of a second embodiment for the above duty control.

Figure 6:
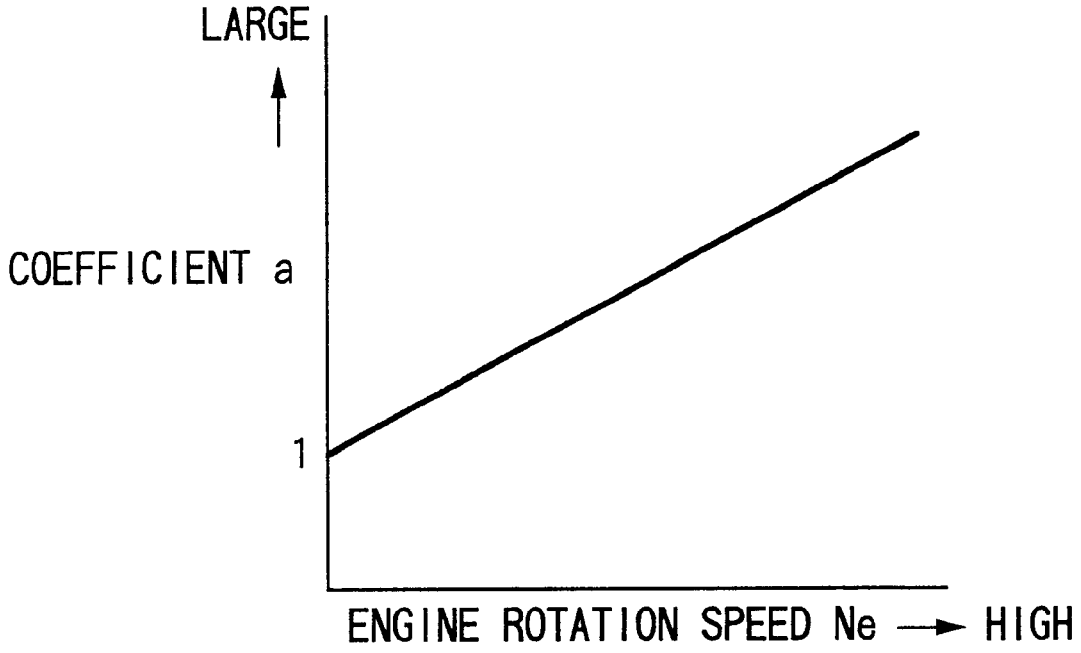
FIG. 6 is a table set with a coefficient "a" to be used in the second embodiment.

The second embodiment is different from the first embodiment in FIG. 4 in that at S23, a coefficient "a" corresponding to the engine rotation speed is retrieved from a table as shown in FIG. 6, and when the limit value of target angle change rate is calculated at S25 and S26, the limit value is set by multiplying the coefficient "a" and the advance side limit value of target angle change rate or the retarded side limit value of target angle change rate. The change rate of target angle can be limited as adapted better for the engine rotation speed.

In the case where the variable valve timing mechanism is applied to the one that controls valve timing of an exhaust valve, since a valve overlap amount is increased when the valve timing of the exhaust valve is controlled to a retarded direction, the retarded side limit value of target angle change rate may be set to a value larger than the advance side limit value of target angle change rate.

The entire contents of a basic Japanese Patent Application No. 2001-154370 filed May 23, 2001, a priority of which is claimed, are herein incorporated by reference.

What is claimed is:

1. An apparatus for controlling a variable valve timing mechanism of an internal combustion engine wherein said variable valve timing mechanism variably controls valve timing of an intake valve or an exhaust valve by changing a rotation phase of a camshaft relative to a crankshaft due to friction braking of an electromagnetic brake, comprising:

a setting device that sets a target value of said rotation phase and a maximum change amount of the target value of said rotation phase as a limit amount of a rotation phase change rate; and a controller that limits a change amount of the target value to be equal to or less than said maximum change amount to control the rotation phase to the target value while limiting the change rate of the rotation phase.

2. An apparatus for controlling a variable valve timing mechanism according to claim 1, further comprising:

a detector that detects said rotation phase, wherein said controller feedback controls the rotation phase detected by said detector to be closer to said target value.

3. An apparatus for controlling a variable valve timing mechanism according to claim 1, wherein said setting device sets said maximum change amount of the target value of said rotation phase as said limit amount of a rotation phase change rate and limits said change amount of the target value to be equal to or less than said maximum change amount, thereby limiting the rotation phase change rate.

4. An apparatus for controlling a variable valve timing mechanism according to claim 1, wherein said setting device sets said limit amount to further limit said rotation phase change rate when a valve overlap amount between the intake valve and the exhaust valve is changed increasingly than when the overlap amount is changed decreasingly.

5. An apparatus for controlling a variable valve timing mechanism according to claim 1, wherein said setting device sets said limit amount to further limit said rotation phase change rate when an engine rotation speed is low than when the engine rotation speed is high.

6. An apparatus for controlling a variable valve timing mechanism according to claim 1, wherein said setting device sets said target value of the rotation phase based on an engine rotation speed and an engine load.

7. An apparatus for controlling a variable valve timing mechanism according to claim 1, further comprising:

a judging device that judges whether the intake valve or the exhaust valve is currently being controlled in an advance condition or in a retarded condition, wherein, when the judging device judges that the intake valve or the exhaust valve is currently being controlled in the advance condition, the maximum change amount of the target value of said rotation phase is calculated to be an advance side limit value of a target angle change at an advance side multiplied by a reference count value, and wherein, when the judging device judges that the intake valve or the exhaust valve is currently being controlled in the retarded condition, the maximum change amount of the target value of said rotation phase is calculated to be a retarded side limit value of a target angle change at an advance side multiplied by the reference count value.

8. An apparatus for controlling a variable valve timing mechanism according to claim 7, wherein the advance side limit value of a target angle change at an advance side corresponds to a first preset value, and wherein the retarded side limit value of a target angle change at an advance side corresponds to a second preset value.

9. An apparatus for controlling a variable valve timing mechanism of an internal combustion engine wherein said variable valve timing mechanism variably controls valve timing of an intake valve or an exhaust valve by changing a rotation phase of a camshaft relative to a crankshaft due to friction braking of an electromagnetic brake, comprising:

target value setting means for setting a target value of said rotation phase;

limit amount setting means for setting a maximum change amount of the target value of said rotation phase as a limit amount of a rotation phase change rate; and rotation phase controlling means for limiting a change amount of the target value to be equal to or less than said maximum change amount to control the rotation phase to the target value while limiting the change rate of the rotation phase.

10. An apparatus for controlling a variable valve timing mechanism according to claim 9, further comprising:

judging means for judging whether the intake valve or the exhaust valve is currently being controlled in an advance condition or in a retarded condition, wherein, when the judging means judges that the intake valve or the exhaust valve is currently being controlled in the advance condition, the maximum change amount of the target value of said rotation phase is calculated to be an advance side limit value of a target angle change at an advance side multiplied by a reference count value, and wherein, when the judging means judges that the intake valve or the exhaust valve is currently being controlled in the retarded condition, the maximum change amount of the target value of said rotation phase is calculated to be a retarded side limit value of a target angle change at an advance side multiplied by the reference count value.

11. An apparatus for controlling a variable valve timing mechanism according to claim 10, wherein the advance side limit value of a target angle change at an advance side corresponds to a first preset value, and wherein the retarded side limit value of a target angle change at an advance side corresponds to a second preset value.

12. A method of controlling a variable valve timing mechanism that variably controls valve timing of an intake valve or an exhaust valve by changing a rotation phase of a camshaft relative to a crankshaft due to friction braking of an electromagnetic brake, comprising:

setting a target value of said rotation phase and a maximum change amount of the target value of said rotation phase as a limit amount of a rotation phase change rate; and limiting a change amount of the target value to be equal to or less than said maximum change amount to control the rotation phase to the target value while limiting the change rate of the rotation phase.

13. A method of controlling a variable valve timing mechanism according to claim 12, wherein said rotation phase is detected, and the detected rotation phase is feedback controlled to be closer to said target value.

14. A method of controlling a variable valve timing mechanism according to claim 12, wherein said maximum change amount of the target value of said rotation phase is set as said limit amount of a rotation phase change rate and said change amount of the target value is limit to be equal to or less than said maximum change amount, thereby limiting the rotation phase change rate.

15. A method of controlling a variable valve timing mechanism according to claim 12, wherein said limit amount is set to further limit said rotation phase change rate when a valve overlap amount between the intake valve and the exhaust valve is changed increasingly than when the overlap amount is changed decreasingly.

16. A method of controlling a variable valve timing mechanism according to claim 12, wherein said limit amount is set to further limit said rotation phase change rate when an engine rotation speed is low than when the engine rotation speed is high.

17. A method of controlling a variable valve timing mechanism according to claim 12, wherein said target value of the rotation phase is set based on an engine rotation speed and an engine load.

* * * * *